US006478174B1

(12) United States Patent
Grazia et al.

(10) Patent No.: US 6,478,174 B1
(45) Date of Patent: Nov. 12, 2002

(54) DEVICE FOR CLOSING BOTTLES CONTAINING LIQUIDS UNDER PRESSURE, ESPECIALLY CHAMPAGNE OR SIMILAR PRODUCTS

(75) Inventors: Orfeo Grazia, Calderara Di Reno; Fabrizio Michelini, S. Martino, both of (IT)

(73) Assignee: Pelliconi Abruzzo s.r.l. (IT)

( * ) Notice: Subject to any disclaimer, the term of this patent is extended or adjusted under 35 U.S.C. 154(b) by 55 days.

(21) Appl. No.: 09/694,572

(22) Filed: Oct. 24, 2000

(30) Foreign Application Priority Data

Oct. 29, 1999 (IT) ..... BO99A0581

(51) Int. Cl.[7] ..... B65D 41/28; B65D 41/10; B65D 53/00

(52) U.S. Cl. ..... 215/320; 215/277; 215/327; 215/349; 215/354

(58) Field of Search ..... 215/277, 291, 215/320, 327, 349, 354, 230

(56) References Cited

U.S. PATENT DOCUMENTS

| | | | | | |
|---|---|---|---|---|---|
| 838,124 | A | * | 12/1906 | Low | 215/354 |
| 1,596,996 | A | * | 8/1926 | Rasmussen | 215/277 |
| 2,004,690 | A | * | 6/1935 | Fonyo | 25/277 |
| 3,032,225 | A | * | 5/1962 | Harding | 215/277 |
| 3,940,005 | A | * | 2/1976 | Granat | 215/325 |
| 4,019,646 | A | * | 4/1977 | Imamura | 215/329 |
| 4,111,323 | A | * | 9/1978 | Ichinose et al. | 215/230 |
| 4,379,512 | A | * | 4/1983 | Ohmi et al. | 215/327 |
| 4,813,557 | A | * | 3/1989 | Herron et al. | 215/329 |
| 6,158,604 | A | * | 12/2000 | Larguia, Jr. et al. | 215/217 |
| 6,179,139 | B1 | * | 1/2001 | Heilman | 215/230 |

FOREIGN PATENT DOCUMENTS

| | | |
|---|---|---|
| EP | 0 594 494 | 4/1994 |
| FR | 2 532 624 | 3/1984 |
| FR | 2 708 251 | 2/1995 |

* cited by examiner

*Primary Examiner*—Lee Young
*Assistant Examiner*—Tri M. Mai
(74) *Attorney, Agent, or Firm*—Nixon & Vanderhye PC

(57) ABSTRACT

The invention relates to a device for closing bottles containing a liquid under pressure, especially champagne or similar products, of the type comprising a cylindrical, hollow stopper having a longitudinal axis and a lateral surface, the stopper being designed to be inserted into the opening of a bottle neck and closed by a transversal surface having a projecting rim that rests on the annular end face of the neck; a closing cap having a peripheral portion that engages the annular outer edge of the neck; a seal engaged to an inner end of the closing cap and acting on the annular end face of the neck and on the transversal surface of the stopper. The seal comprises an annular protuberance extending continuously towards the inside of the bottle and having a first, thick outer portion that acts on an outer portion of the annular end face of the bottle neck, and a second, thin portion that extends towards the longitudinal axis in such a way as to act on the annular end face of the neck and on the transversal surface of the stopper. [Figure 1]

7 Claims, 1 Drawing Sheet

DEVICE FOR CLOSING BOTTLES CONTAINING LIQUIDS UNDER PRESSURE, ESPECIALLY CHAMPAGNE OR SIMILAR PRODUCTS

BACKGROUND OF THE INVENTION

The present invention relates to a device for temporarily closing bottles containing champagne or similar products, that is to say, liquids under pressure.

It is known that champagne and sparkling wines are fermented directly in the bottle in two or more different stages of production. The time between one stage and the next may be quite long.

At the end of some of these stages, the bottles have to be opened and, therefore, temporary closing devices are used. These devices must prevent the liquid and gas from escaping from the bottle during the entire production stage, which, in some cases, may last several years. During this time, the temporary closing device is subjected to pressures of as much as 6 to 8 BAR by the gas that develops inside the bottle.

Usually, a temporary closing device used for this purpose comprises a substantially cylindrical, hollow stopper closed at the top by a transversal surface that extends past the lateral surface of the cylinder, in such a way as to create a supporting surface. The stopper is made of a synthetic material and is pressed into the neck of the bottle until its supporting surface comes into contact with the rim of the bottle mouth.

A metal sealing capsule is then fitted over the stopper to keep the latter in place. The edge of the capsule, usually of the crown type, is designed to be clamped over the outer annular edge of the bottle neck.

Attached to the inside face of the capsule, between the latter and the stopper inserted in the bottle neck, there is a seal which is designed to press against the annular end face of the bottle neck and against the transversal surface of the stopper. The seal, acting in conjunction with the stopper, is designed to prevent the gas and liquid from escaping for the required length of time.

In known temporary closing devices (see publication EP-594494), the edge of the seal has two diverging annular lips which move apart on opposite sides so as to cover the annular end face of the bottle neck, thus sealing the bottle.

To prevent the stopper from being pushed outwards along the bottle neck by the pressure inside the bottle, thus diminishing the effectiveness of the seal, the latter has a plurality of equally-spaced bosses around the edge of it, close to the two lips. Once the capsule has been applied, the bosses act on the transversal surface of the stopper, close to the edge, thus keeping the stopper in position and preventing stresses that would diminish the effectiveness of the remaining part of the seal applied to the glass.

However, devices of this kind have some disadvantages.

The bosses, which are designed to hold the stopper in place, complicate the structure of the seal, making it more difficult to manufacture.

Moreover, the position of the bosses around the edge of the transversal surface of the stopper creates breaks in the contact with the surface and does not prevent the internal gas pressure from causing a swelling in the transversal surface over the opening in the bottle neck. This swelling deforms the lateral surface of the stopper, which tends to converge towards the axis of the stopper itself close to the end of it that faces the inside of the bottle.

This in turn causes the lateral surfaces of the stopper to become detached from the inside surface of the bottle neck, allowing gas and liquid to leak towards the seal and lessening the effectiveness of the seal, especially considering the fact that the temporary closing device has to remain on for long periods of time.

The aim of the present invention is to overcome the above mentioned drawbacks.

BRIEF DESCRIPTION OF THE DRAWINGS

The technical features of the present invention, in accordance with the above mentioned aim, are set out in the claims herein and the advantages more clearly illustrated in the detailed description which follows, with reference. to the accompanying drawings, which illustrate a preferred embodiment of the invention without restricting the scope of its application, and in which:

DESCRIPTION OF THE PREFERRED EMBODIMENTS

Figure 1:
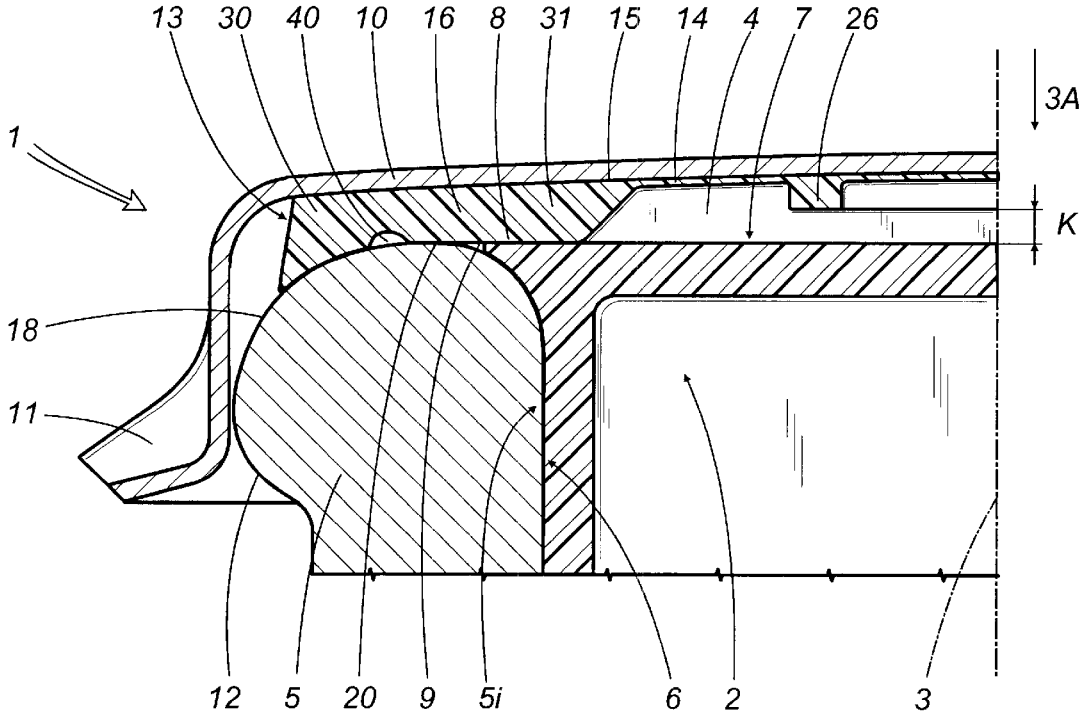
FIG. 1 is an axial cross section of a preferred embodiment of the closing device made according to the present invention, inserted in the neck of a bottle.

With reference to the accompanying drawings, the numeral 1 indicates a device for temporarily closing bottles containing a liquid such as champagne or a similar product.

The device comprises a substantially cylindrical, hollow stopper 2 that can be inserted into the opening 4 of a bottle neck 5 in a direction 3A corresponding to the longitudinal axis 3 of the stopper.

The size of the stopper 2 is such that a certain amount of force is required to insert it into the opening 4 so that its lateral surface 6 is kept closely in contact with the inside surface 5*i* of the bottle neck 5.

The stopper 2 is closed at the top end by a transversal surface 7 that has a projecting rim 8 which comes to rest against the annular end face 9 of the neck 5 when the stopper 2 is inserted.

The device further comprises a closing capsule 10, made preferably of metal, having a peripheral portion 11 that engages with the outer annular edge 12 of the neck 5. The peripheral portion 11 is preferably of the crown type and is conventionally engaged with the outer annular edge 12 of the neck 5 by clamping the crown (in FIG. 1, the crown is shown in the unclamped position).

On the inside of the end 14 of the closing capsule 10 there is a seal 13 that presses against the annular end face 9 of the neck 5 and against the transversal surface 7 of the stopper 2.

The seal 13 is made preferably of a deformable synthetic material and, at its edge 15, has an annular protuberance 16 extending towards the inside of the bottle beyond the point where the inner surface of the neck 5 meets the stopper 2.

When the capsule 10 is applied, the annular protuberance 16 acts on the annular end face 9 of the neck 5 and on the transversal surface 7 of the stopper 2 to make the seal more effective against gas leaks from the bottle.

In a preferred embodiment of the invention, the annular protuberance 16 has a thick portion 30 whose cross section is shaped substantially like a rectangle trapezium whose hypotenuse 23 faces the annular end face 9 of the neck 5.

Figure 2:
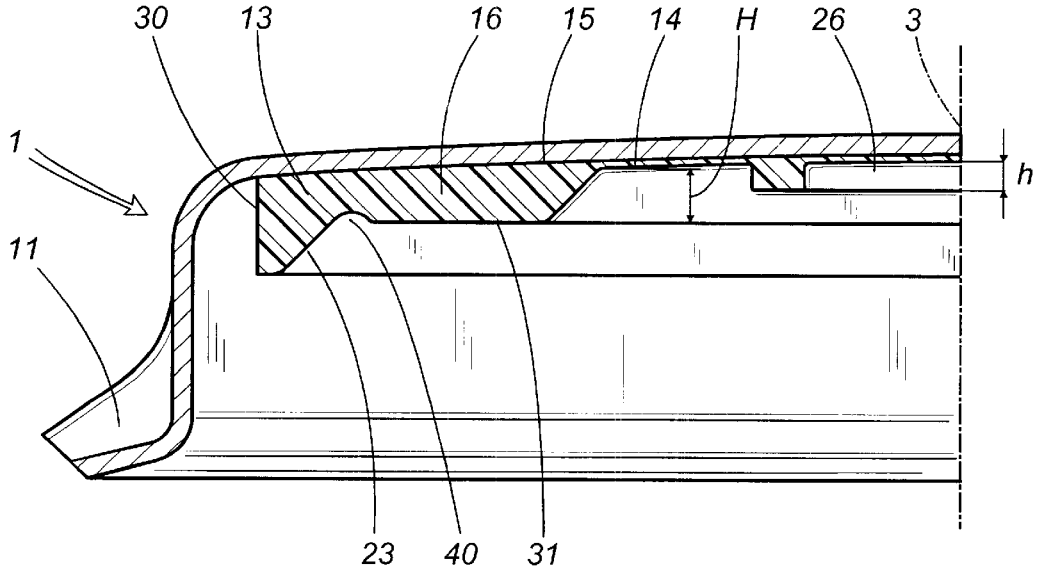
FIG. 2 is an axial cross section of a preferred embodiment of the device shown in FIG. 1, not inserted in the neck of a bottle.

Further, in the embodiment shown in FIG. 2, the protuberance 16 has a concavity 40 at the point where the thickness changes. Thus, after the closing cap 10 has been applied, the thick portion 30 tends, on deforming, to follow the outer profile of the bottle neck 5, covering the outer portion 18 of the annular end face 9 of the neck 5. In the thin portion, the protuberance 16 deforms in such a way as to follow the shape of the inner portion 20 of the annular end face 9 and of the transversal surface 7 of the stopper 2. This creates a practically continuous seal that covers the entire annular end face 9 of the neck 5 and, at the same time, holds the stopper 2 down tightly in the bottle neck.

A novel feature of the seal 13 is that it comprises at least one stop element 26 which extends from it towards the inside of the closing capsule 10 close to the longitudinal axis 3 and which, when the bottle is in the closed configuration, is positioned between the longitudinal axis 3 and the lateral surface 6 of the stopper 2.

When the pressure caused by the gas formed inside the bottle tends to cause a swelling in the transversal surface 7, the stop element 26 opposes the swelling action, thus reducing or canceling the deformation of the lateral surface 6 of the stopper 2 and hence its tendency to become detached from the inside surface of the bottle neck 5.

In the embodiment shown in FIG. 2, the stop element 26 extends towards the inside of the bottle by a height H that is smaller than the height H of the annular protuberance 16, that is to say, in the closed configuration, it extends as far as a defined distance K (see FIG. 1) from the transversal surface 7 of the stopper 2. This prevents the stopper 2 from being excessively constrained and allows the transversal surface 7 to be deformed, within defined limits depending also on the material it is made of, until it comes into contact with the stop element 26.

Advantageously, the stop element 26 consists of a continuous annular structure centered on the longitudinal axis 3 of the stopper 2. Thus, the transversal surface 7 deforms uniformly and the swelling pressure inside the bottle is opposed more effectively.

The invention has significant advantages. The swelling of the transversal surface 7 of the stopper 2 is limited, which means that the deformation of the lateral surface 6 of the stopper 2 is reduced to the minimum, thus preventing leakage of liquid and gas to the seal 13. The temporary closing device forming the subject-matter of the present invention, is therefore able to better guarantee the quality of the bottle contents during the long process stages.

Moreover, the present invention provides a seal 13 that is easy to manufacture, thanks to its extremely simple structure, and that is capable of creating a practically uninterrupted sealing surface covering the entire annular end face 9 of the bottle neck 5 while at same time preventing the stopper 2 from being pushed outwards along the neck.

The invention described can be subject to modifications and variations without thereby departing from the scope of the inventive concept. Moreover, all the details of the invention may be substituted by technically equivalent elements.

What is claimed is:

1. A closing device for bottles containing a liquid under pressure, especially champagne products, being of the type comprising:

a substantially cylindrical, hollow stopper having a longitudinal axis and a lateral surface, the stopper being designed to be inserted, in the direction corresponding to the longitudinal axis, into the opening of a bottle neck, and being closed by a transversal surface having a projecting rim that rests on the annular end face of the neck;

a closing capsule having a peripheral portion that engages with the outer annular edge of the neck; and a seal, fitted on the inside of one end of the closing capsule and acting on the annular end face of the neck and on the transversal surface of the stopper;

wherein the seal comprises an annular protuberance extending continuously towards the inside of the bottle and having a first, thick outer portion that acts on an outer portion of the annular end face of the bottle neck, and a second, thin portion that extends towards the longitudinal axis in such a way as to act on the annular end face of the neck and on the transversal surface of the stopper.

2. The device according to claim 1, wherein the seal further comprises at least one stop element, having a substantially annular shape, located between the longitudinal axis and the lateral surface of the stopper and extending towards the inside of the bottle so as to limit the swelling of the transversal surface over the opening of the bottle neck.

3. The device according to claim 2, wherein the stop element consists of a continuous annular structure centered on the longitudinal axis of the stopper.

4. The device according to claim 2, wherein the stop element is located at a defined distance from the transversal surface of the stopper.

5. The device according to claim 1, wherein the annular protuberance comprises a concavity close to the point where its thickness changes.

6. The device according to claim 1, wherein the thick portion has a cross section shaped substantially like a rectangle trapezium whose hypotenuse faces the annular end face of the neck.

7. The device according to claim 1, wherein the seal is made of a synthetic material.

* * * * *